US012018909B1

(12) United States Patent
Barnett

(10) Patent No.: US 12,018,909 B1
(45) Date of Patent: Jun. 25, 2024

(54) CROSSBOW HAVING A HALO-TYPE CABLE HUB

(71) Applicant: Barnett Outdoors, LLC, Tarpon Springs, FL (US)

(72) Inventor: David A. Barnett, Tarpon Springs, FL (US)

(73) Assignee: BARNETT OUTDOORS, LLC, Tarpon Springs, FL (US)

( * ) Notice: Subject to any disclaimer, the term of this patent is extended or adjusted under 35 U.S.C. 154(b) by 0 days.

(21) Appl. No.: 18/378,171

(22) Filed: Oct. 10, 2023

Related U.S. Application Data

(60) Provisional application No. 63/432,144, filed on Dec. 13, 2022.

(51) Int. Cl.
*F41B 5/12* (2006.01)

(52) U.S. Cl.
CPC ..... *F41B 5/123* (2013.01)

(58) Field of Classification Search
CPC ..... F41B 5/123
See application file for complete search history.

(56) References Cited

U.S. PATENT DOCUMENTS

| | | | | |
|---|---|---|---|---|
| 4,457,288 | A | 7/1984 | Ricord | |
| 7,637,256 | B2 | 12/2009 | Lee | |
| 8,651,095 | B2 | 2/2014 | Islas | |
| 9,494,379 | B2 | 11/2016 | Yehle | |
| 9,829,268 | B1 | 11/2017 | Kempf et al. | |
| 10,859,338 | B2 * | 12/2020 | Polanich | F41B 5/1403 |
| 11,022,398 | B1 * | 6/2021 | Kempf | F41B 5/105 |
| 11,085,728 | B2 * | 8/2021 | Yehle | F41B 5/105 |
| 11,635,274 | B2 * | 4/2023 | Trpkovski | F41B 5/123 124/25 |
| 2022/0307791 | A1 * | 9/2022 | Trpkovski | F41B 5/123 |

* cited by examiner

*Primary Examiner* — John A Ricci
(74) *Attorney, Agent, or Firm* — Donald J. Ersler

(57) ABSTRACT

The crossbow preferably includes a rail, a riser, two energy storing components, (such as two limbs), two cams, and a bowstring harness. The bowstring harness is operably coupled with the cams. A halo-type cable hub is operably coupled with the bow riser or rail. The bowstring harness is operably coupled with the halo-type cable hub. The halo-type cable hub has a first side and a second side, an upper portion and a lower portion, and is of a material that is stronger than the material of the riser and rail. The first and seconds sides are preferably built as mirror images of each other at a centerline of the rail.

4 Claims, 9 Drawing Sheets

CROSSBOW HAVING A HALO-TYPE CABLE HUB

1. CROSS-REFERENCES TO RELATED APPLICATIONS

This is a non-provisional patent application which claims the benefit of provisional patent application No. 63/432,144, filed on Dec. 13, 2022.

BACKGROUND OF THE INVENTION

2. Field of the Invention

The present invention relates generally to archery and more specifically to a crossbow with a unique halo-type cable hub, which allows a portion of first and second cables to be engaged to a first and second cam, and the cables do not cross the center line of the crossbow frame. This arrangement enables the device to have self-timing. The present invention may alternately use components other than flexible limbs for storing energy prior to launching the projectile. The present invention may be used in a reverse-draw style or conventional-draw style crossbow, having the bowstring located between the axles of the cams and the string latch mechanism, or having the string located forward the cam axles. The halo-type cable hub entirely encompasses the rail of the crossbow frame, as well as the opening of the riser in which the rail couples with the riser. The halo-type cable hub is of a material that may be stronger then the material of the riser.

3. Discussion of the Prior Art

Historically, archery bows and crossbows have been used for war, survival, sport, and recreation. A specific component of a compound style shooting bow are the cables. Typically, each cable includes a power end and a control end. The manner in which the cables interact with the cams and limbs of the bow is of particular importance. Typically, the power end of the cable is coupled to the cam on one limb, and the control end of the cable is often coupled to the opposite limb or opposite cam. A very good way to accomplish efficiency is through a binary cam system, wherein the cables are connected to opposing cams, and as one of the cams wraps the cable on the power track, the opposite cam pays out cable from the control track. While all of these methods work to some extent, all have significant issues with performance related to cam lean, and/or assembly and cost. Due to the crossing of cables and the need to keep the cables from interfering with the flight of the arrow, the cables often are off-angle, which in turn creates twisting and torque in a cam axle, thus creating cam lean.

U.S. Pat. No. 4,457,288 to Ricord discloses a cam lever compound bow, where a bow utilizes single string wrapping pulleys journaled to the ends of the bow limbs, and the ends of the string are coupled to a cam device mounted upon the bow riser. Although, this method does remove the problem of the cables being in the way, it is very inefficient, and timing issues from one limb to the other is a factor. U.S. Pat. No. 7,637,256 to Lee discloses a compound bow, which provides a shooting bow that removes the issue of cables interfering with the flight of the arrow. However, the inefficient use of tensioning devices severely limits the potential of this device. U.S. Pat. No. 8,651,095 to Islas discloses a bowstring cam arrangement for compound crossbow, which provides a method of removing the cables from the path of the string. U.S. Pat. No. 9,494,379 to Yehle discloses a crossbow, where Yehle relies on four cables. Issues are created by having separate cables above and below the string track on each cam. If the cables are not of exact length, or if the upper cable stretches more than the lower cable, or visa-versa, the cables must be adjusted by the user to stay in time with each other. Further, Yehle teaches a cable anchoring component, or hub, that is generally "U" shaped giving structural integrity to only a portion of the dynamic load area created by the anchoring of the cables on either side of the center rail. The "U" shaped cable support structure is of the same material as the riser, and is mechanically fastened to the rail, having the threaded fasteners in line with the cables. The force of the cables are pulling directly on the threads of the fasteners, the pull-out strength of the threads being the weakest link.

Timing of the cables can be a time consuming and a very difficult process. U.S. Pat. No. 9,829,268 to Kempf et. al. teaches a cable configuration wherein the cables are anchored to the cams near the center line of the crossbow and the mid-portion of the cables pass through portals, which allows for self-timing. However this does not disclose use of a halo-type cable hub.

Accordingly, there is a clearly felt need in the art to provide a crossbow, which allows a mid-portion of first and second cables to be slidably engaged on first and second cams, and the ends of the cables are coupled to a halo-style cable hub, respectively, wherein the cam is allowed to rotate at least 200 degrees and preferably up to at least 360 degrees. The cables do not cross the centerline of the shooting ow. Further, the halo-type cable hub is preferably fabricated of a material that is stronger than the material of the riser.

SUMMARY OF THE INVENTION

For reference throughout the claims and specifications, the term "crossbow" will be defined as a projectile launching device that is capable of firing an arrow, bolt, or other projectile. The "crossbow, may have limbs that are solid or split, or other energy storage components such as springs or pistons. The "crossbow" shall have a bowstring, and at least one power cable. The "crossbow" may have a rail that the bowstring engages, or of the rail-less design. The crossbow may be of conventional draw, conventional draw with reverse cams, or reverse draw. The "crossbow" may or may not have a built-in cocking aid. The "crossbow" will have a bowstring retainment and release mechanism.

The term "limb" may refer to what are known as solid limbs, split-limbs, tube-limbs, or any other flexible energy storing component.

For clarity, the word coupled is being defined as a way to connect an object, such as a bowstring or cable, with another object, be it directly or indirectly, such as directly to a post or pulley, or indirectly as in from the end of a string or cable, to an intermediate object, and then to a limb or axle.

The term "rail" is used as a general term describing an elongated component that directly or indirectly supports the front of an arrow. "Rail-less" crossbows still have an elongated component that is coupled with a riser or other structure, wherein the elongated component directly or indirectly supports the front of an arrow.

The term "encompass" shall mean at least a portion of a second body that completely surrounds at least a portion of a first body, without interruption of the second body.

The present invention provides a self-timing cam and cable configuration for a crossbow. The anchoring system for the ends of the power cables include a halo-type cable hub that encompasses the distal end of the rail and launch deck of a riser. The halo-type cable hub is made from a material that is structurally stronger than the material that the riser is fabricated of. Examples of the increased strength include the riser being made from 6061T6 Aluminum, and the halo-type cable hub being made from 7075 Aluminum, or that the riser being made from a molded composite, and the halo-type cable hub made from 6061T6 Aluminum. The benefit of this configuration is that the riser may be made from a lower cost or lighter material that achieves the required structural integrity of the riser portion, while the halo-type cable hub may require a stronger, heavier, or more costly material to achieve the required structural integrity of the cable hub. The halo-type cable hub may be made in a single or multiple piece configuration, having multiple cable interface components. These cable interface components preferably include pulleys, mounting posts, anchors, and the like, where there are mirrored cable interface components on either side of the centerline of the crossbow rail. The cable interface components are located above and below the centerline of the bowstring. Further, the cable interface components may also incorporate the structural mechanical fasteners for retaining the halo-type cable hub with the bow riser and rail. These mechanical fasteners are perpendicular to the pulling force of the cables, relying on the shear strength of the fasteners to maintain the proximity of the cable interface components, as opposed to the pull-out thread strength of prior art. A first preferred embodiment has a first upper and lower cable transitions and anchor posts, and a second upper and lower cable transitions and anchor posts. A second preferred embodiment may have a first upper and lower cable anchor post, and a second upper and lower cable anchor post.

The present invention includes a pair of cables, wherein both ends of the same cable anchor on opposing sides of the halo cable hub, which also reduces or eliminates cam lean. The crossbow preferably includes a first cam, a second cam, a launch string and two cables, collectively known as a harness system. This configuration allows opposing ends of a first cable to be anchored to a first side of the halo cable hub, and opposing end of a second cable to be anchored to the second side of the halo cable hub. Preferably, the first and second cables do not cross a centerline of the shooting bow. In a second preferred embodiment, the crossbow preferably includes a string latch housing, a bow riser, a rail, a first energy storing device (such as a first limb), a second energy storing device (such as a second limb), a first cam, a second cam, at least one bowstring, and at least two cables.

The bow riser is coupled with the rail. One end of the first limb extends from a first end of the bow riser and one end of the second limb extends from a second end of the bow riser. The first cam is pivotally retained on the first limb and the second cam is pivotally retained on the second limb. A first end of the launch string is retained by the first cam and a second end of the launch string is retained by the second cam. The first cam includes a first cam launch string track, an upper first cam cable track, located above the launch string track, and a lower first cam cable track, located below the launch string track, and a cable portal. The second cam includes a second cam launch string track, an upper second cam cable track, located above the launch string track, and a lower second cam cable track, located below the launch string track, and a cable portal. The first set of first and second cable transitions and anchor posts are located above the plane of the launch string, and the second set of first and second cable transitions and anchor posts are located below the plane of the launch string.

The bow riser has a rail interface surface within a bore sized to receive a rail and flight deck, and a halo interface surface encompassing the bore. The rail has a riser interface surface sized to cooperate with the riser. The halo-type cable hub is sized to encompass and engage the halo interface surface of the riser. The rail may be mechanically coupled with the riser, integrated with the riser, or chemically bonded with the riser.

In the preferred embodiment, the halo-type cable hub has an upper and a lower portion. The upper and lower portions are assembled encompassing the riser halo interface surface. Cooperating bores in the halo upper and lower provide alignment for the cable interface components. First and second lower transition posts are formed to receive a fastener head and shoulder of a shoulder bolt. First and second upper transition posts are formed to receive the shoulder and threads of the fasteners. First and second lower anchor posts are formed to receive a fastener head and shoulder of a shoulder bolt. The shoulder bolts are inserted from the bottom through the corresponding bores. First and second upper anchor posts are formed to receive the shoulder and threads of the fasteners. In addition to mechanical fasteners, bonding agents may be used to engage the halo with the riser.

A first end of the first cable is retained by the first upper anchor post; a segment adjacent the first cable end of the first cable partially engages the first upper cable transition; the middle of the first cable engages the portal of the first cam; a segment adjacent the second cable end partially engages the first lower cable transition; and a second end of the first cable is retained by the first lower anchor post. A first end of the second cable is retained by the second upper anchor post; a segment adjacent the first cable end partially engages the second upper cable transition; the middle of the second cable engages the portal of the second cam; a segment adjacent the second cable end partially engages the second lower cable transition; and a second end of the second cable is retained by the second lower anchor post. When the launch string is drawn from a rest position to a ready to fire position, the first cam rotates in a first direction and the second cam rotates in a second direction. As the first and second cams rotate, the launch string is unwound from the first and second launch string tracks. Simultaneously, the first and second cables wind into the first and second cable tracks of the first and second cams.

A unique feature of the present invention is that both ends of the first and second cables are firmly retained by the anchor posts, and the middle portions "float" or slide relative to the first and second cable portals. The first and second cables are of one piece, and as the cable stretches, it self-centers itself about the cable portals.

In a preferred embodiment, the launch string may be releasably retained in the ready-to-fire position by mechanisms known as a string latch assembly or a string release.

In an alternative embodiment, the same harness system configuration may be used on crossbows utilizing energy storing components other than flexible limbs. These other types of energy storing components include spring(s), hydraulics, or pressurized cylinder(s).

In alternate embodiments, a conventional-draw crossbow having standard cams, or reverse having the bowstring unwind from the front of the cams. There is only one cable per cam, each cable having a first end and a second end, a first span, a mid-segment, and a second span. Ends of the cables are anchored to the first upper and lower anchor posts cooperating with the halo. The first spans are above the bowstring, the mid segments engage a cable portals, and the second spans are below the bowstring.

Accordingly, there is a clearly felt need in the art for a crossbow with no cam lean, having a first cam, a second cam, a launch string and at least two cables, collectively known as a harness system, where both ends of the same cable are rigidly attached to the cable posts of the halo, and the mid-portion of each cable at least partially engages the cam portals.

These and additional objects, advantages, features and benefits of the present invention will become apparent from the following specification. Though specific descriptions outline the preferred embodiments, alterations to the invention that alter only the component type or cooperation and not the alter the function of the halo fall within the scope of the claims of the embodiment. Further, in a reverse draw style crossbow, the halo-type cable hub would be coupled with the rail instead of the riser.

DETAILED DESCRIPTION OF THE PREFERRED EMBODIMENTS

Figure 1:
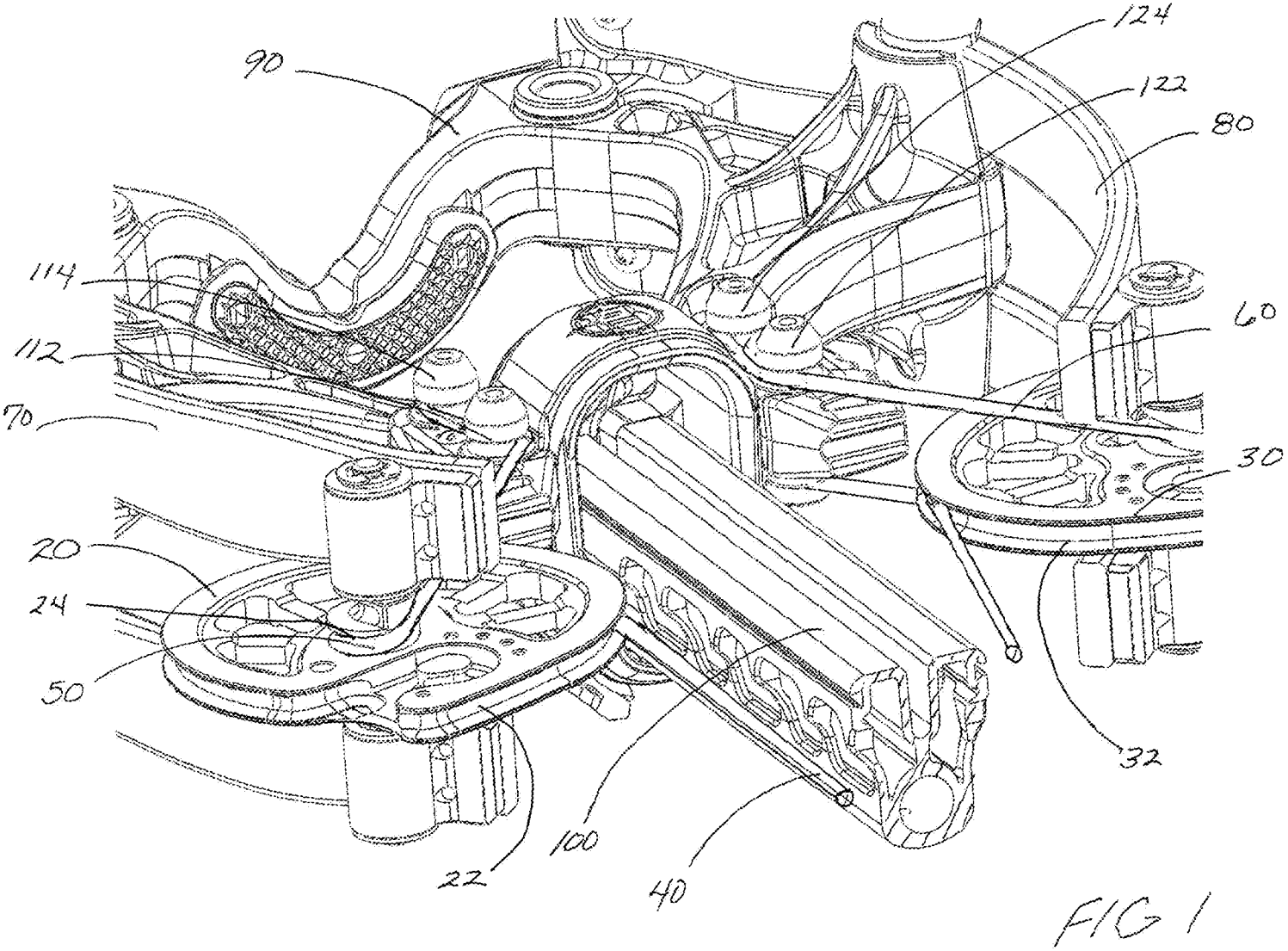
FIG. 1 is a partial perspective view of a crossbow having a halo-type cable hub in accordance with the present invention.
Figure 2:
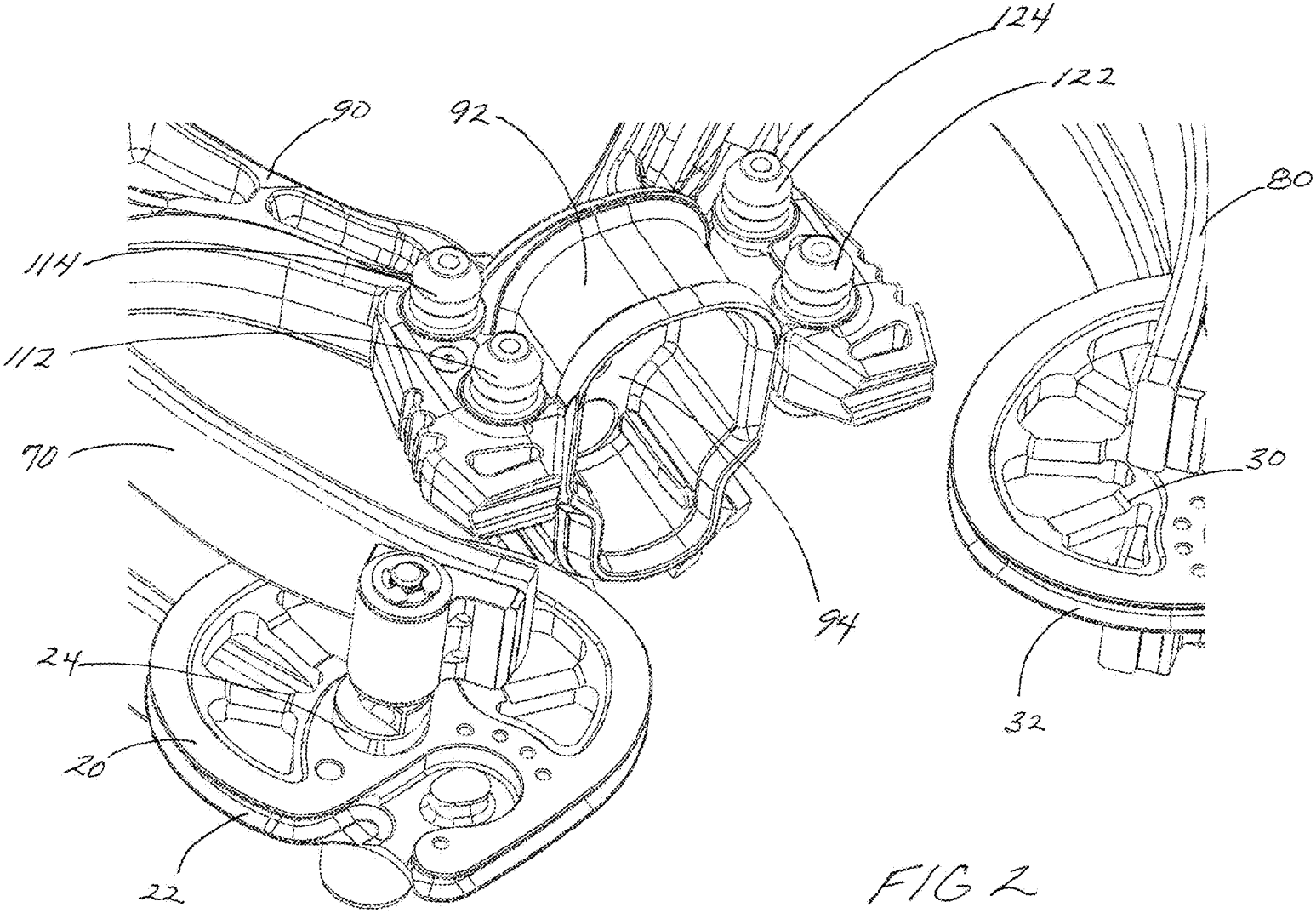
FIG. 2 is a partial front perspective view of a riser assembly having a halo-type cable hub in accordance with the present invention.
Figure 3:
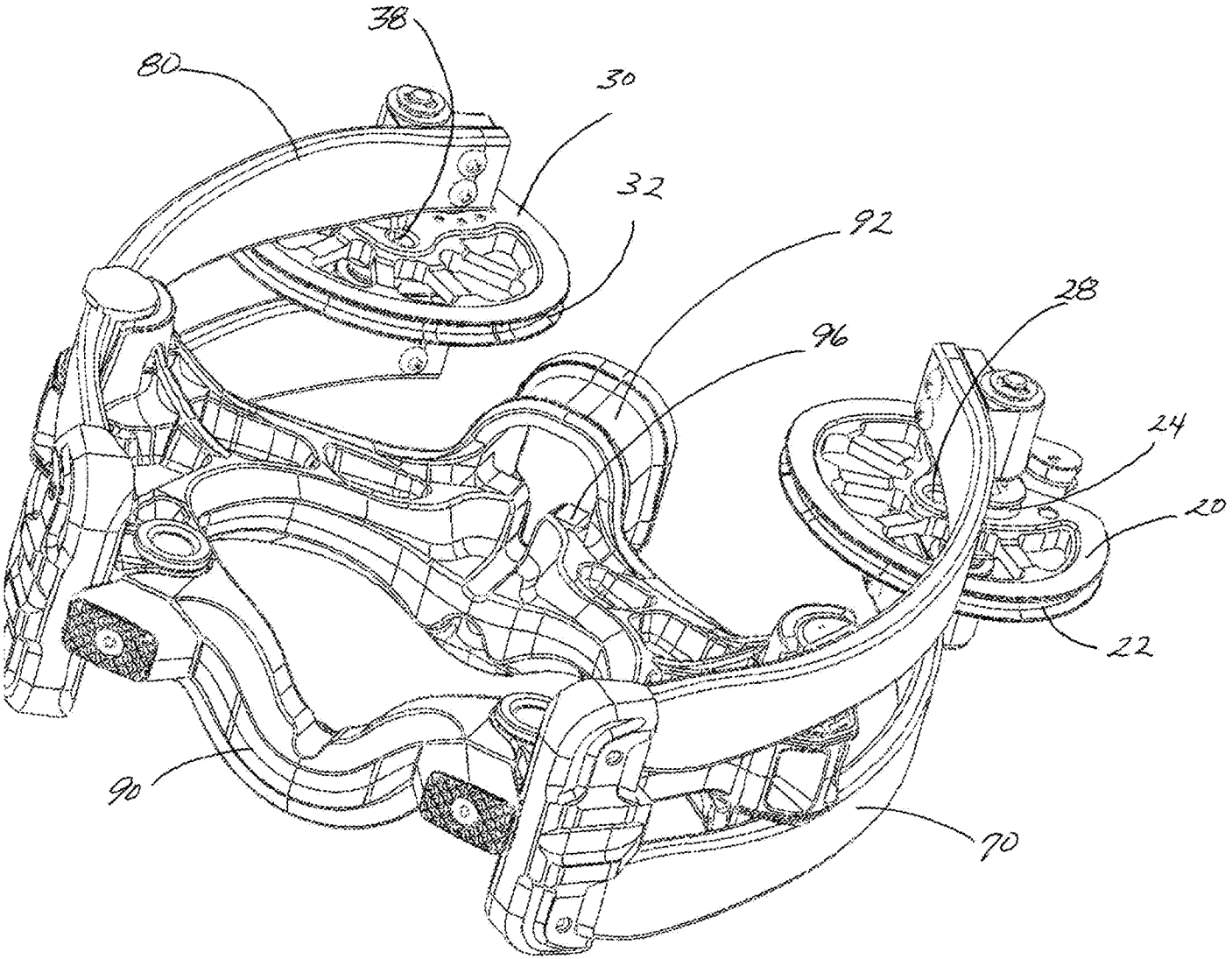
FIG. 3 is a rear perspective view of a riser assembly having a halo-type cable hub receiver surface in accordance with the present invention.
Figure 4:
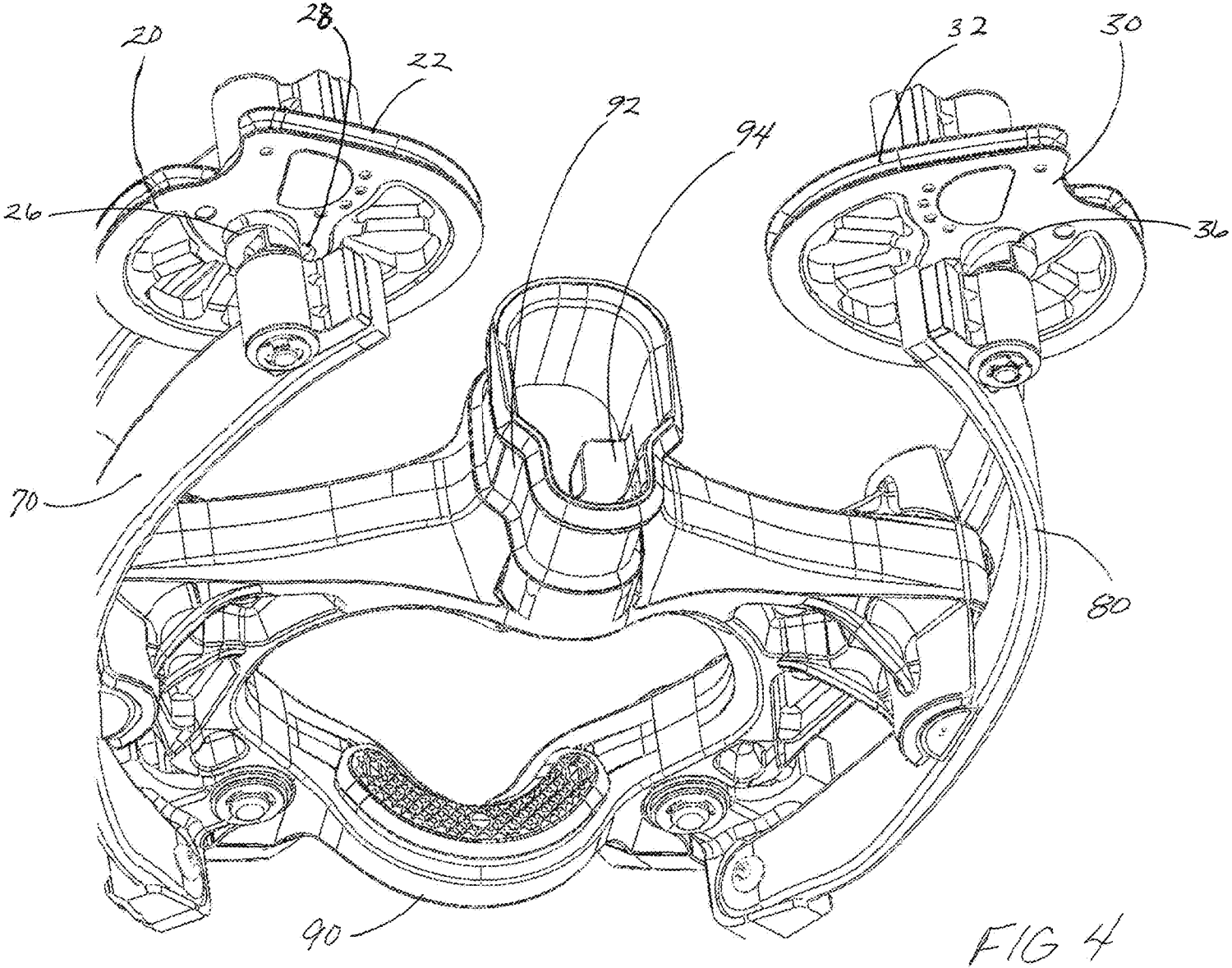
FIG. 4 is a partial bottom perspective view of a riser assembly having a halo-type cable hub receiver surface in accordance with the present invention.
Figure 5:
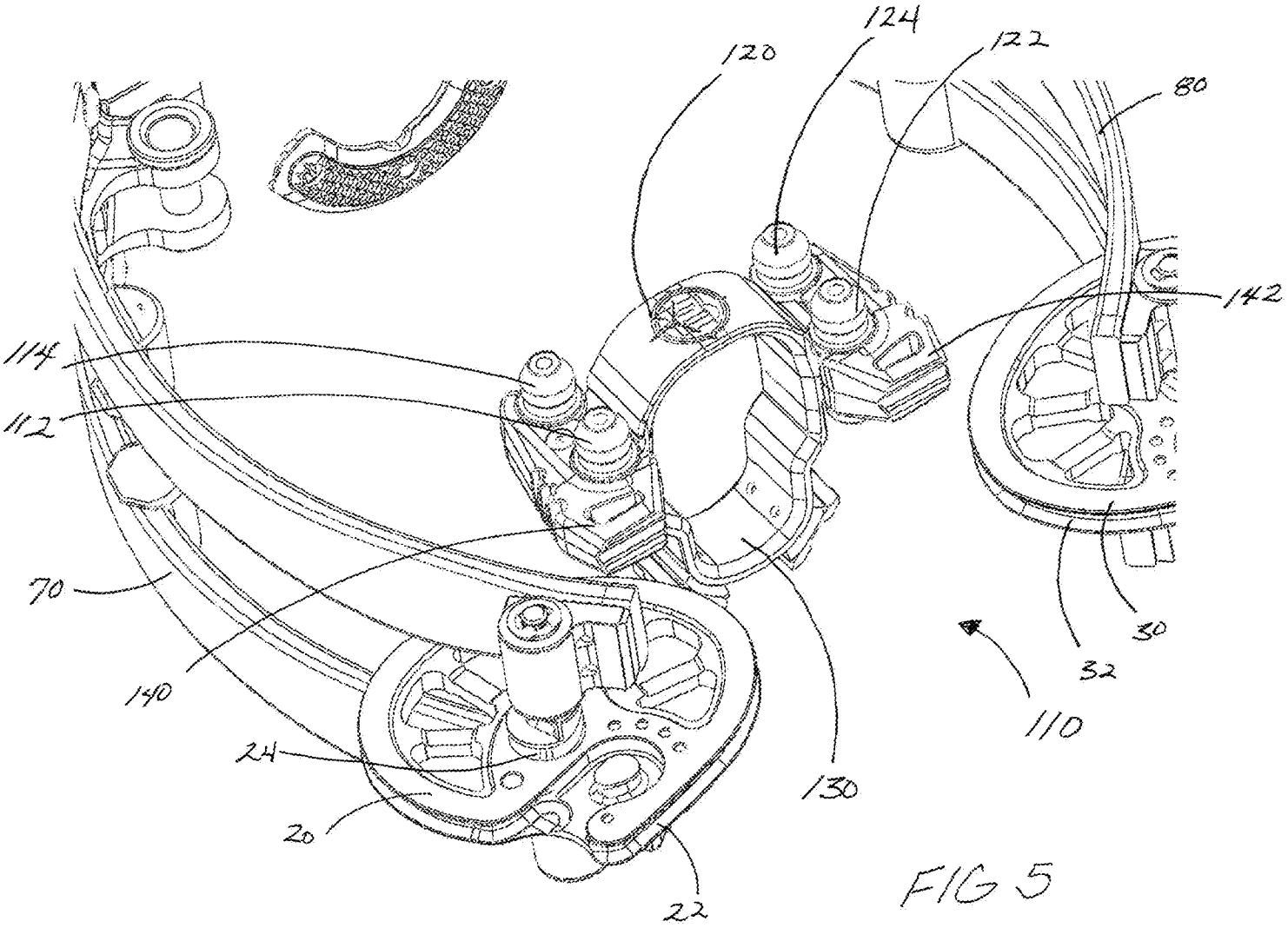
FIG. 5 is a perspective view of a halo-type cable hub, adjacent a pair of limbs with cams in accordance with the present invention.
Figure 6:
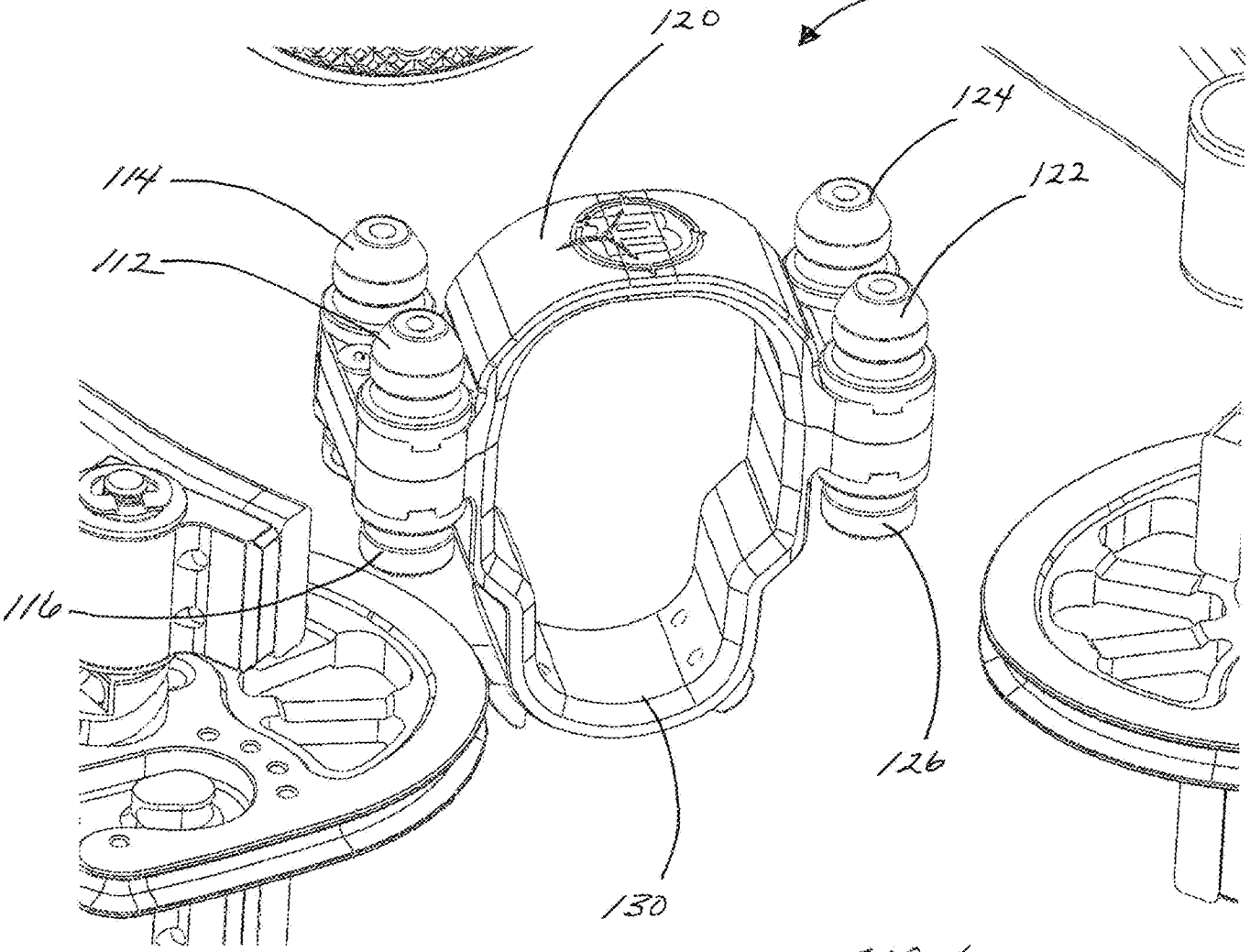
FIG. 6 is a close-up perspective view of a halo-type cable hub, adjacent a pair of limbs in accordance with the present invention.
Figure 7:
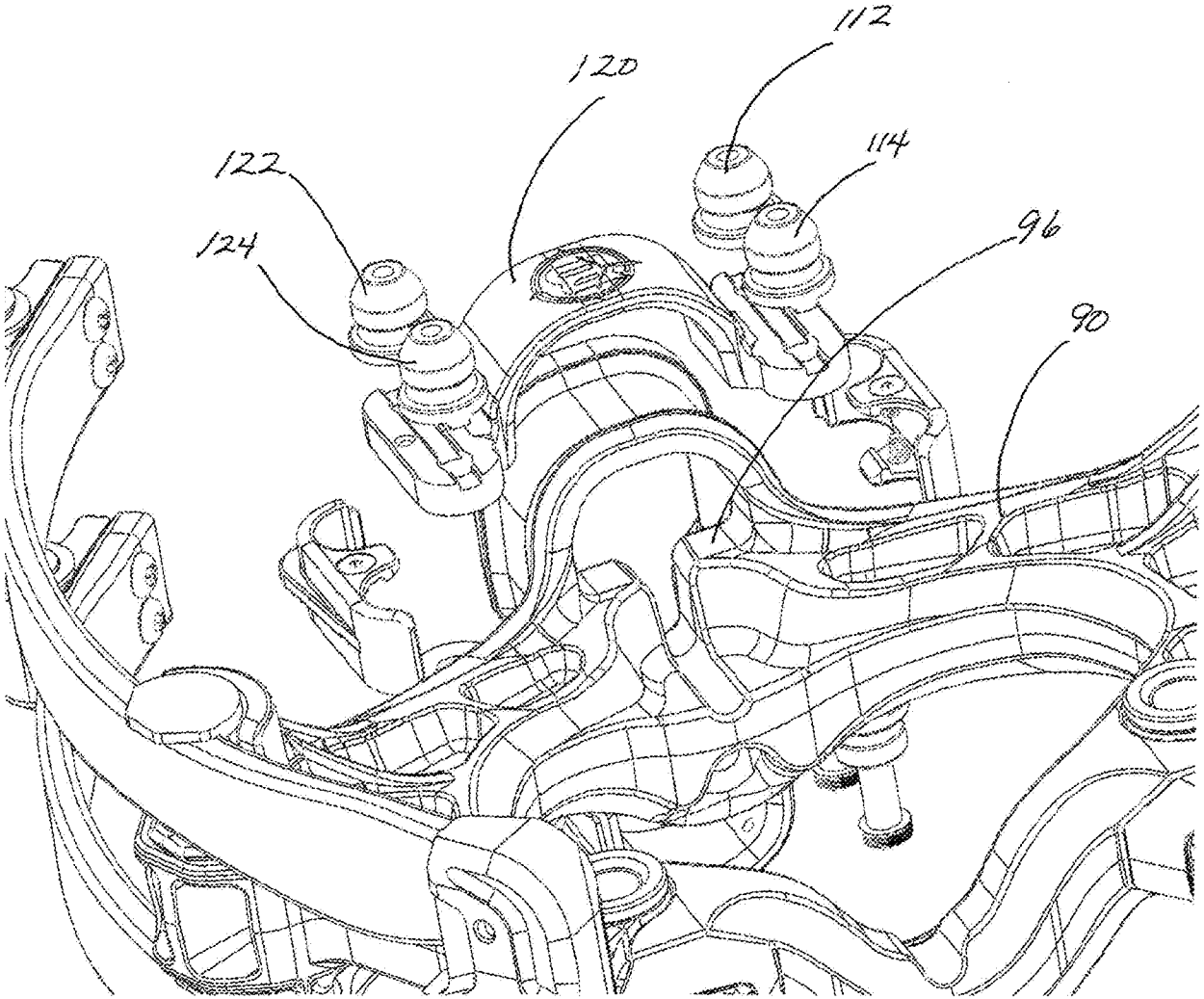
FIG. 7 is a partial exploded rear perspective view of a riser and a halo-type cable hub in accordance with the present invention.
Figure 8:
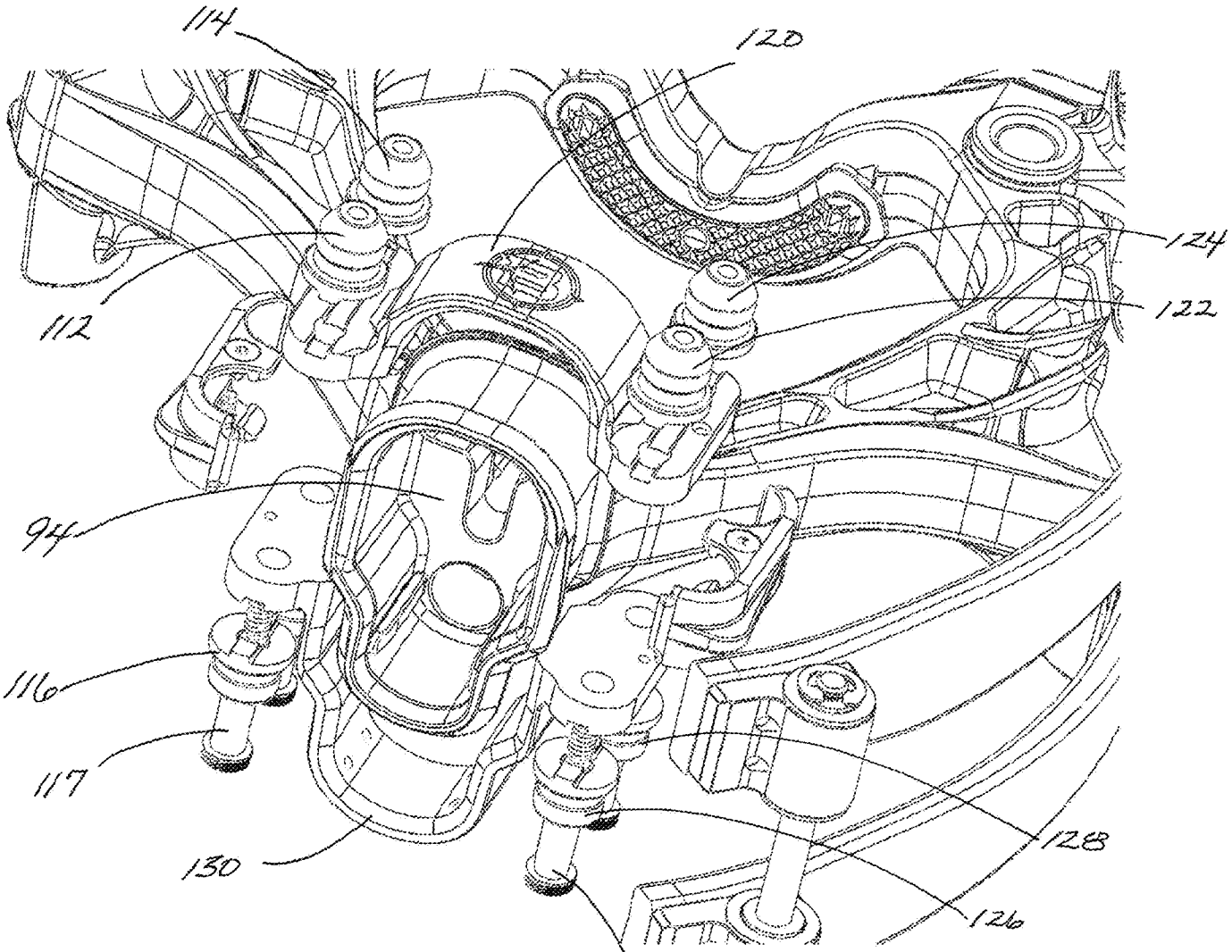
FIG. 8 is a partial exploded front perspective view of a riser and a halo-type cable hub in accordance with the present invention.
Figure 9:
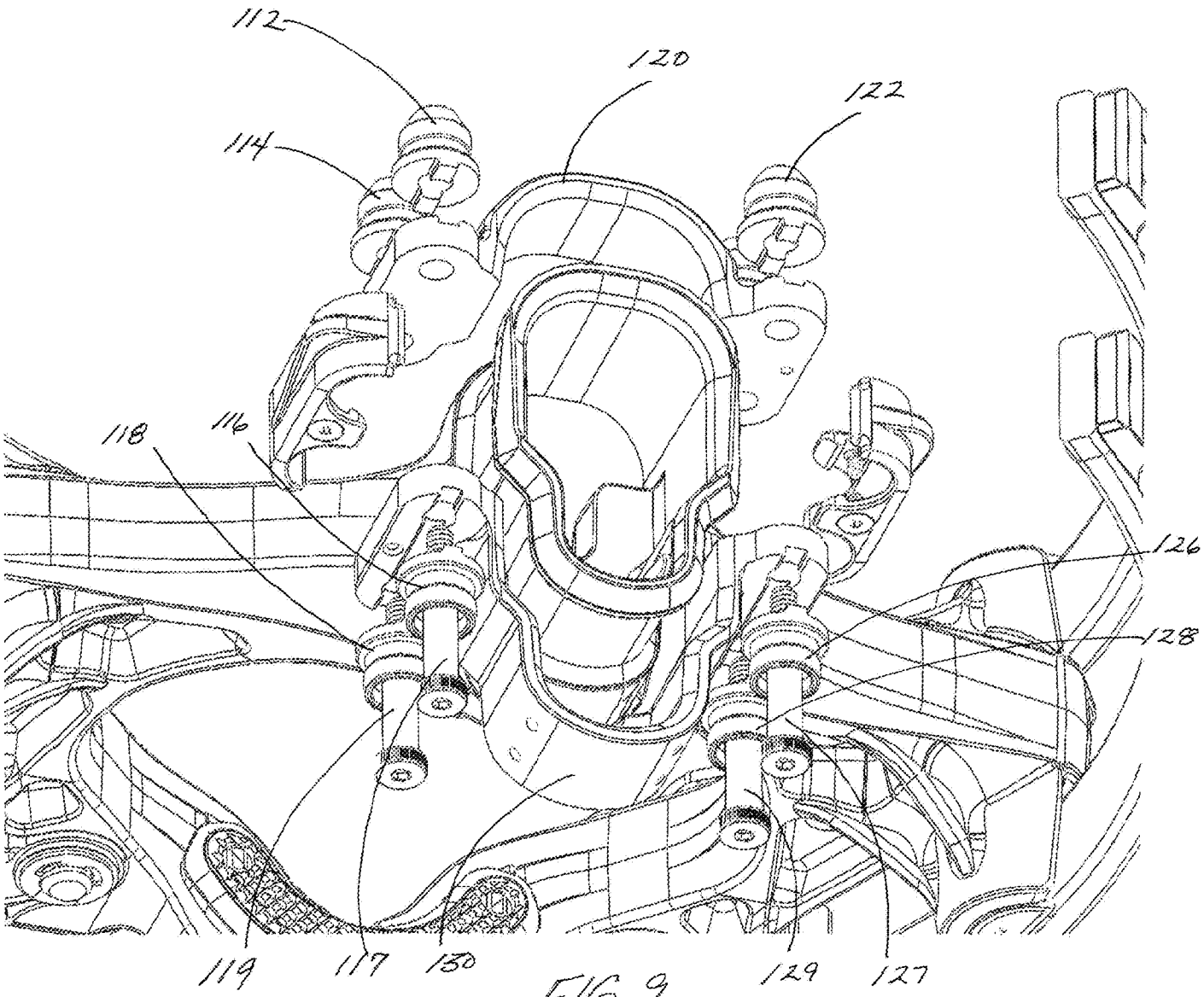
FIG. 9 is a partial exploded bottom perspective view of a riser and a halo-type cable hub in accordance with the present invention.

With reference now to the drawings, and particularly to FIG. 5, there is shown a preferred embodiment of a crossbow having a halo-type cable hub assembly 110. With reference to FIGS. 1-4 and 6-9, the halo-type cable hub assembly 110 has a halo upper portion 120 and a halo lower portion 130. A first upper cable transition post 112 and a first lower cable transition 116, and a first upper anchor post 114, a first lower anchor post 118, a second upper cable transition 122, a second lower cable transition 126, a second upper anchor post 124 and a second lower anchor post 128. A second preferred embodiment (not shown) may eliminate the cable transitions, and may have first upper and lower cable anchor posts 114, 118, and second upper and lower cable anchor posts 124, 128.

The present invention includes a first cable 50 and a second cable 60, wherein both ends of the first cable anchor on the first side of the halo-type cable hub, and both ends of the second cable anchor on the second side of the halo-type cable hub, which also reduces or eliminates cam lean. The crossbow preferably includes a first cam 20, a second cam 30, a launch string (not shown) and two cables 50 and 60, collectively known as a harness system. This configuration allows opposing ends of a first cable 50 to be anchored to a first side of the halo-type cable hub assembly 110, and opposing end of a second cable 60 to be anchored to the second side of the halo-type cable hub assembly 110. Preferably, the first and second cables do not cross a centerline of the shooting bow. In a second preferred embodiment, the crossbow preferably includes a string latch housing (not shown), a bow riser 90, a rail 100, a first energy storing device 70 (such as a first limb), a second energy storing device 80 (such as a second limb), a first cam 20, a second cam 30, at least one launch string, and at least two cables 50 and 60.

The bow riser 90 is coupled with the rail 100. One end of the first limb 70 extends from a first end of the bow riser 90 and one end of the second limb 80 extends from a second end of the bow riser 90. The first cam 20 is pivotally retained on the first limb 70 and the second cam 30 is pivotally retained on the second limb 80. A first end of the launch string is retained by the first cam 20 and a second end of the launch string is retained by the second cam 30. The first cam 20 includes a first cam launch string track 22, an upper first cam cable track 24, located above the launch string track 22, and a lower first cam cable track 26 located below the launch string track 22, and a cable portal 28. The second cam 30 includes a second cam launch string track 32, an upper second cam cable track (not shown), located above the launch string track 32, and a lower second cam cable track 36, located below the launch string track 32, and a cable portal 38.

The first set of first and second cable transition posts 112, 122 and anchor posts 114, 124 are located above the plane of the launch string, and the second set of first and second cable transitions 116 and 126, and the anchor posts 118, 128 are located below the plane of the launch string. The bow riser 90 has a rail interface surface 94 within a bore sized to receive the rail 100 and flight deck, and a halo interface surface 92 encompassing the bore. The rail 100 has a riser interface surface (not shown) sized to cooperate with the riser 90. The upper and lower halo-type cable hubs 120, 130 are to encompass and engage the halo interface surface 92 of the riser 90. The rail 100 may be mechanically coupled with the riser 90, integrated with the riser 90, or chemically bonded with the riser 90.

In the preferred embodiment, the halo-type cable hub assembly 110 has an upper 120 and a lower portion 130. The upper 120 and lower 130 portions are assembled encompassing the riser halo interface surface 92. Cooperating bores in the halo upper 120 and lower 130 provide alignment for the cable interface components. First and second lower transition posts 116, 126 are formed to receive a fastener head and shoulder of the shoulder bolts 117 and 127. The first set of first and second cable transition posts 112, 122 are formed to receive the shoulder and threads of the shoulder bolts 117 and 127.

The first and second lower anchor posts 118, 128 are formed to receive a fastener head and shoulder of the shoulder bolts 119 and 129. The shoulder bolts 119, 129 are inserted from the bottom through the corresponding interface components and through the bores of the lower halo-type cable hub 130. A first upper anchor post 114 and a second upper anchor post 124 are formed to receive the shoulder and threads of the shoulder bolts 119 and 129. In addition to mechanical fasteners, bonding agents may be used to engage the halo-type hub assembly 110 with the riser.

A first end of the first cable 50 is retained by the first upper anchor post 114; a segment adjacent the first cable end of the first cable 50 partially engages the first upper cable transition post 112; the middle of the first cable 50 engages the first portal 28 of the first cam 20; a segment adjacent the second cable end of the first cable 50 partially engages the first lower cable transition post 116; and a second end of the first cable 50 is retained by the first lower anchor post 118. A first end of the second cable 60 is retained by the second upper anchor post 124; a segment adjacent the first end of the second cable 60 partially engages the second upper cable transition post 122; the middle of the second cable 60 engages the portal 38 of the second cam 30; a segment adjacent the second end of the second cable 60 partially engages the second lower cable transition post 126; and a second end of the second cable 60 is retained by the second lower anchor post 128. When the launch string is drawn from a rest position to a ready to fire position, the first cam 20 rotates in a first direction and the second cam 30 rotates in a second direction. As the first and second cams rotate, the launch string is unwound from the first and second launch string tracks 22, 32. Simultaneously, the first 50 and second 60 cables wind into the first cable tracks 24, 34, and the second cable tracks 26, 36 of the first and second cams 20 and 30.

A unique feature of the present invention is that both ends of the first and second cables 50, 60 are firmly retained by the anchor posts, and the middle portions "float" or slide relative to the first and second cable portals 28, 38. The first and second cables, 50, 60 are of one piece, and as the cable stretches, it self-centers itself about the cable portals 28, 38.

In a preferred embodiment, the launch string may be releasably retained in the ready-to-fire position by mechanisms known as a string latch assembly or a string release.

In an alternative embodiment, the same harness system configuration may be used on crossbows utilizing energy storing components other than flexible limbs. These other types of energy storing components include spring(s), hydraulics, or pressurized cylinder(s).

In alternate embodiment, a conventional-draw crossbow having standard cams, or reverse cams having the bowstring unwind from the front of the cams. There is only one cable per cam, each cable having a first end and a second end, a first span, a mid-segment, and a second span. Ends of the cables 50 and 60 are anchored to the first upper and lower anchor posts 114, 118 and cooperate with the halo assembly 110. The first spans are above the bowstring, the mid segments engage the cable portals 28 and 38, and the second spans are below the bowstring. In yet another alternate embodiment, the halo-type cable hub may be of one-piece construction as opposed to an upper portion and a lower portion.

For clarity, the word coupled is being defined as a way to connect an object, such as a bowstring or cable, with another object, be it directly or indirectly, such as directly to a post or pulley, or indirectly as in from the end of a string or cable, to an intermediate object, and then to a limb or axle.

Accordingly, there is a clearly felt need in the art for a crossbow with no cam lean, having a first cam, a second cam, a launch string and at least two cables, collectively known as a harness system, where both ends of the same cable are rigidly attached to the cable posts of the halo-type hub assembly, and the mid-portion of each cable at least partially engages the cam portals.

These and additional objects, advantages, features and benefits of the present invention will become apparent from the following specification. Though specific descriptions outline the preferred embodiments, alterations to the invention that alter only the component type or cooperation and not the alter the function of the halo fall within the scope of the claims of the embodiment.

I claim:

1. A crossbow comprising:

a riser and a rail, said riser and a distal end of said rail are coupled together within a bore in said riser, said bore is internally sized to encompass and receive said rail and at least the cross-sectional diameter of an arrow and externally sized to receive a halo-type cable hub;

the halo-type cable hub having an inner surface sized to encompass and receive the external surface of the bore of said riser; a first upper and lower cable anchor, and a second upper and lower cable anchor coupled with said halo-type cable hub;

a bowstring harness having a bowstring and at least one cable; and a first 3-track cam and a second 3-track cam, wherein the bowstring harness is operably coupled with said first and second 3-track cams and said halo-type cable hub.

2. A crossbow comprising:

a riser and a rail, said riser and a distal end of said rail are coupled together within a bore in said riser, said bore is internally sized to encompass and receive the distal end of said rail and at least the cross-sectional diameter of an arrow and externally sized to receive a halo-type cable hub;

the halo-type cable hub having an upper portion and lower portion that are sized to encompass and couple with the external surface of the bore of said riser;

a first upper and lower cable anchor, and a second upper and lower cable anchor coupled with said halo-type cable hub; and a launch string, a first cable coupled with a first 3-track cam and a second cable coupled with a second 3-track cam, each one of said first and second 3-track cams include a string track, an upper cable track and a lower cable track, said string track is located between said upper and lower cable tracks, wherein said launch string having a first segment retained in said string track of said first 3-track cam and a second segment retained in said string track of said second 3-track cam, the first end of said first cable is coupled to a first upper cable anchor and the second end of said first cable is coupled to a first lower cable anchor, the first end of said second cable is coupled to a second upper cable anchor and second end of said second cable is coupled to a second lower cable anchor.

3. A crossbow comprising:

a riser and a rail, said riser and said rail are coupled together;

a halo-type cable hub operably coupled with said rail, the halo-type cable hub having an inner surface sized to receive and fully surround an outer perimeter of said rail and an outer perimeter of an arrow;

a first upper and lower cable anchor, and a second upper and lower cable anchor coupled with said halo-type cable hub;

a bowstring harness having a bowstring and at least one cable; and a first 3-track cam and a second 3-track cam, wherein the bowstring harness is operably coupled with said first and second 3-track cams and said halo-type cable hub.

4. A crossbow comprising:

a riser and a rail, said riser and said rail are coupled together;

a halo-type cable hub operably coupled with said rail, the halo-type cable hub having an inner surface sized to encompass and receive an external surface of the rail and cross-sectional diameter of an arrow;

a first upper and lower cable anchor, and a second upper and lower cable anchor coupled with said halo-type cable hub;

a first 3-track cam and a second 3-track cam, a launch string, a first cable coupled with said first cam and a second cable coupled with said second cam, each one of said first and second 3-track cams include a string track, a upper cable track and a lower cable track, said string track is located between said first and second cable tracks, wherein said launch string having a first segment retained in said string track of said first 3-track cam and a second segment retained in said string track of said second 3-track cam, each of said first and second cables have a first end, a second end and a mid-segment, said mid-segment of said first cable is retained in a first cam portal, said mid-segment of said second cable is retained in a second cam portal, said first end of said first cable is coupled to a first upper cable anchor and a second end of said first cable is coupled to a first lower cable anchor, said first end of said second cable is coupled to a second upper cable anchor and a second end of said second cable is coupled to a second lower cable anchor.

* * * * *